United States Patent [19]

Yaguinuma

[11] 4,108,355

[45] Aug. 22, 1978

[54] ROTARY INDICATING DEVICE PROVIDED WITH A PLURALITY OF INDICATING PLATES

[75] Inventor: Jusuke Yaguinuma, Tokyo, Japan

[73] Assignee: Copal Company Limited, Tokyo, Japan

[21] Appl. No.: 729,868

[22] Filed: Oct. 5, 1976

[30] Foreign Application Priority Data

Oct. 6, 1975 [JP] Japan ..... 50-136445[U]

[51] Int. Cl.[2] ..... G09F 11/06; G04B 19/02

[52] U.S. Cl. ..... 235/1 C; 40/495; 58/125 C; 40/500

[58] Field of Search ..... 235/1 C; 58/125 C; 40/73.4

[56] References Cited

U.S. PATENT DOCUMENTS

| | | | |
|---|---|---|---|
| 2,040,421 | 5/1936 | Almquist | 58/125 C |
| 3,822,808 | 7/1974 | Katakura et al. | 235/94 R |
| 3,823,552 | 7/1974 | Boyles | 58/125 C |

*Primary Examiner*—Stephen J. Tomsky

*Attorney, Agent, or Firm*—Cushman, Darby & Cushman

[57] ABSTRACT

A rotary indicating device comprising a rotary drum supporting respectively rotatably a plurality of indicating plates, a ring-shaped spring fitted on one side surface of the rotary drum and resiliently pressing the respective rotary shaft portions of the plurality of indicating plates in a direction along the diameter of the rotary drum and a member for turning the plurality of indicating plates in turn with the rotation of the rotary drum so as to be able to be simply assembled and to stably hold the indicating plates in the indicating position.

1 Claim, 9 Drawing Figures

ROTARY INDICATING DEVICE PROVIDED WITH A PLURALITY OF INDICATING PLATES

BACKGROUND OF THE INVENTION

1. Field of the Invention

The present invention relates to indicating devices and more particularly to a rotary indicating device provided with a plurality of indicating plates.

2. Description of the Prior Art

A conventional rotary indicating device provided with a plurality of indicating plates comprises, as shown in FIG. 1, a rotary drum 1 having a pair of side plates each provided with a plurality of radially extended supporting arms, a plurality of indicating plates 2 each rotatably supported by the supporting arms and having, for example, different digits printed on the front and back surfaces and a C-shaped guide ring 3 for holding the indicating surfaces of the respective indicating plates 2 in the normal positions and is so arranged that, when the indicating plates 2 pass the end portions 3*a* and 3*b* of the guide ring 3 with the rotation of the rotary drum 1, either of the end portion 3*a* and 3*b* will turn the indicating plates 2 and will show in turn in an indicating window not illustrated such indicating media as the digits printed on the front surfaces and back surfaces of the respective indicating plates. According to such arrangement. There are such defects that in case the indicating plates 2 are to be assembled inside the guide ring 3, it will be so toilsome to arrange the indicating surfaces of the indicating plates 2 in a predetermined order that the number of assembling steps will increase and that, as there is some clearance between a hole 1*a* made in the tip portion of the supporting arm and a projection 2*a* formed on the side edge of the indicating plate 2 to be fitted in this hole 1*a* to make the rotary drum 1 rotatably support the indicating plate 2, in case a shock is given to the indicating device from outside, the indicating plate 2 will vibrate to cause trouble in reading the indicating medium appearing in the indicating window.

SUMMARY OF THE INVENTION

A primary object of the present invention is to provide a rotary indicating device wherein a plurality of indicating plates rotatably supported by a rotary drum are resiliently pressed always in a fixed direction so that each indicating plate may be held stably without using the guide ring as in the prior device.

Another object of the present invention is to provide a rotary indicating device wherein a plurality of indicating plates can be easily assembled in a rotary drum and can be quickly turned.

DESCRIPTION OF THE PREFERRED EMBODIMENTS

Figure 1:
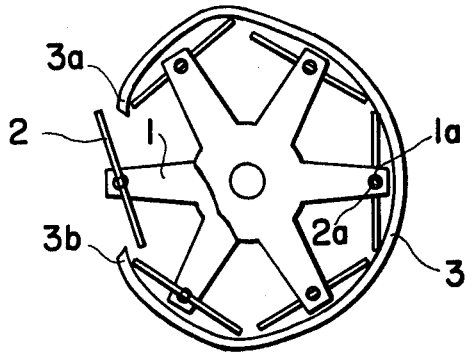
FIG. 1 PRIOR ART
FIG. 1 is a side view of an essential part of a rotary indicating device according to the prior art.
Figure 2:
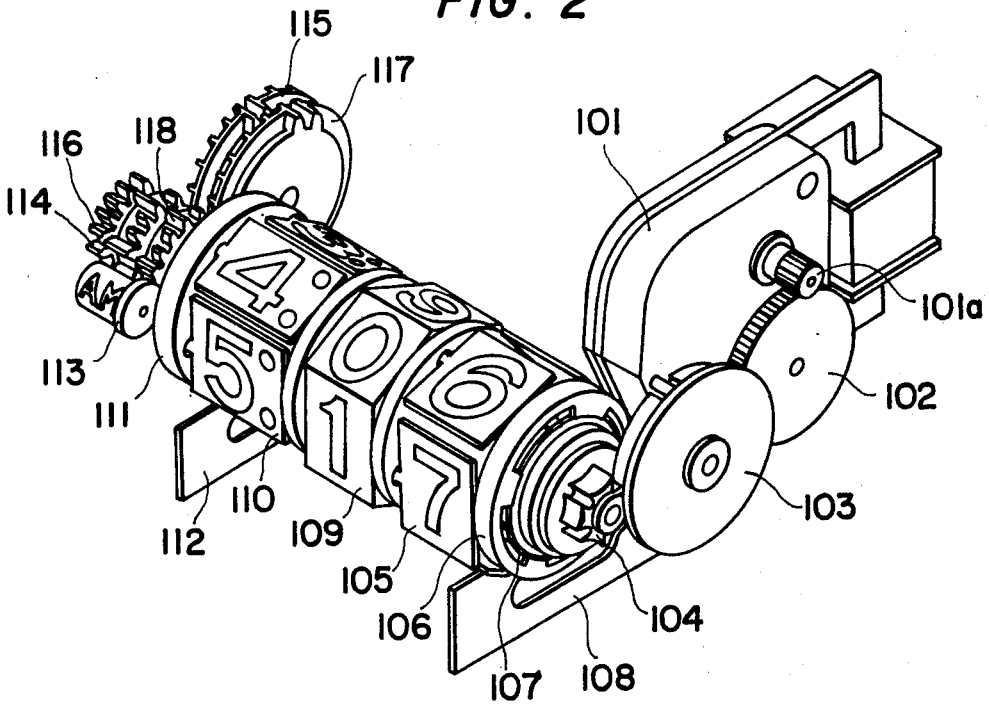
FIG. 2 is a perspective view of an embodiment in which a rotary indicating device according to the present invention is applied to a part of a digital clock apparatus.

In FIG. 2, there is shown a digital clock mechanism in a part of which a rotary indicating device according to the present invention is used. According to this mechanism, the rotation of a pinion 101*a* of a motor 101 is made an intermittent feed at intervals of 1 minute and a first "minute" figure indicating drum 106 is intermittenlly rotated through a clutch mechanism (not illustrated) provided between the intermittent gear 104 and first "minute" figure indicating drum 106 so that, with each rotation of said first "minute" figure indicating drum 106, a turning member 108 may turn indicating plates, that is, digit plates 106 and that the front surfaces and back surfaces of the digit plates 105 may be thus indicated in turn. With the rotation of the first "minute" figure indicating drum 106, a power transmitting gear 114 fixed to a main shaft (not illustrated) fixed to the first "minute" figure indicating drum 106 will be rotated by the main shaft so as to rotate an intermittent large gear 115. The intermittent large gear 115 will intermittently rotate an intermittent small gear 116. The intermittent small gear 116 is connected with a second "minute" figure indicating drum 109 having digits printed on the respective six surfaces through an "hour" indicating drum 111 by a cylindrical shaft not illustrated so as to rotate integrally with the intermittent small gear 116 to indicate the second "minute" figure. The intermittent small gear 116 will transmit the rotation in mesh with an intermittent large gear 117. The intermittent large gear 117 will intermittenlly rotate an intermittent small gear 118. The drum 111 connected with the intermittent small gear 118 by a connecting means not illustrated and having "hour" indicating plates 110 assembled in it will be rotated integrally with the intermittent small gear 118. The "hour" indicating plates 110 will be turned by a turning member 112 with each rotation of the "hour" indicating drum 111 to thus indicate the front surfaces and rear surfaces in turn. On the other hand, an indicating part 113 driven by an intermittent feeding mechanism (not illustrated) provided integrally with the "hour" indicating drum 111 will indicate "A.M." or "P.M." with the rotation of the "hour" indicating drum 111.

Figure 3A:
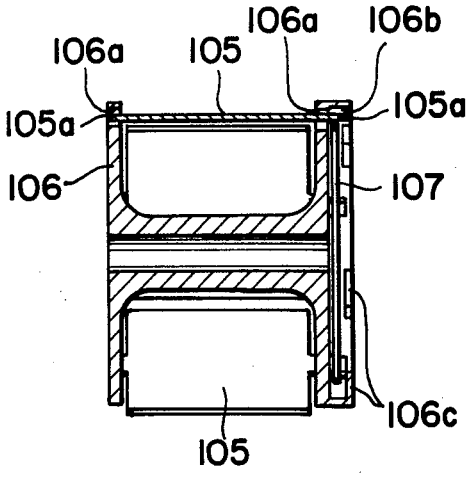
FIGS. 3*a* and 3*b* are respectively a sectioned view and side view of an essential part of the rotary indicating device shown in FIG. 1.
Figure 3B:
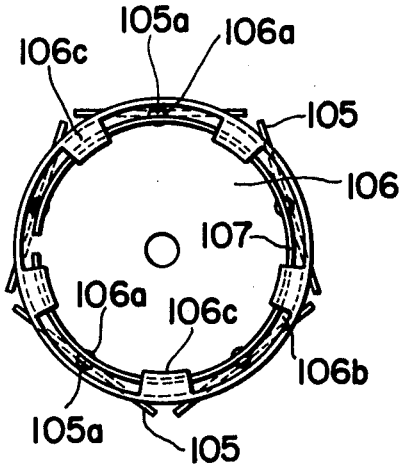

In such time indicating device as is described above, the first "minute" figure indicating part is arranged as shown in FIGS. 3*a* and 3*b*. That is to say, holes 106*a* by which five digit plates 105 are to be respectively rotatably supported are made at regular intervals in both flange portions of the reel-shaped first "minute" figure indicating drum 106. On the other hand, portions 106*c* to prevent a later described ring-shaped spring 107 from dropping off one flange portion 106*b* are respectively integrally formed in one flange portion 106*b*. The digit plates 105 are supported rotatably with respect to the drum 6 by inserting a pair of projecting portions 105*a* projected sidewise from the middle parts of the side edges of each digit plate 105 respectively into holes 106*a* made in both flange portions of the drum 106. The projecting portion 105*a* of the digit plate 5 is rectangular in the cross-section as clearly shown in FIG. 3*b*. These projecting portions 105*a* are always pressed outward along the diameters of the drum 106 by a ring-shaped spring 107 formed so as to be of an arc larger than of the circle including said projecting portions 105*a*.

Figure 4A:
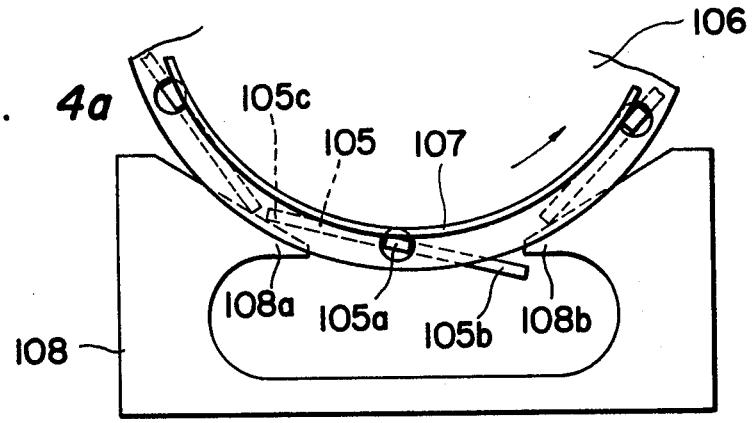
FIGS. 4*a*, 4*b* and 4*c* are respectively explanatory views explaining operating processes of the rotary indicating device shown in FIG. 1.
Figure 4B:
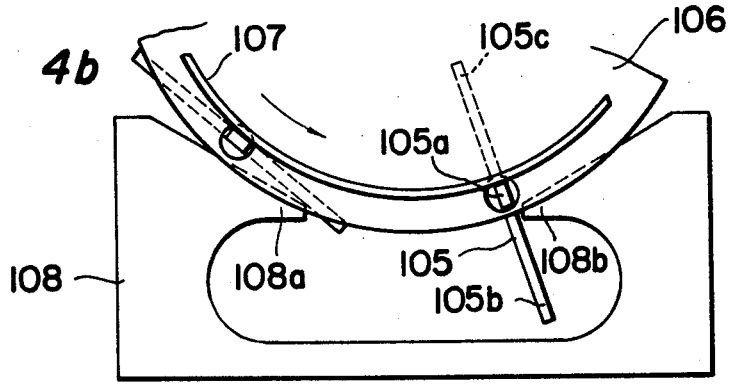
Figure 4C:
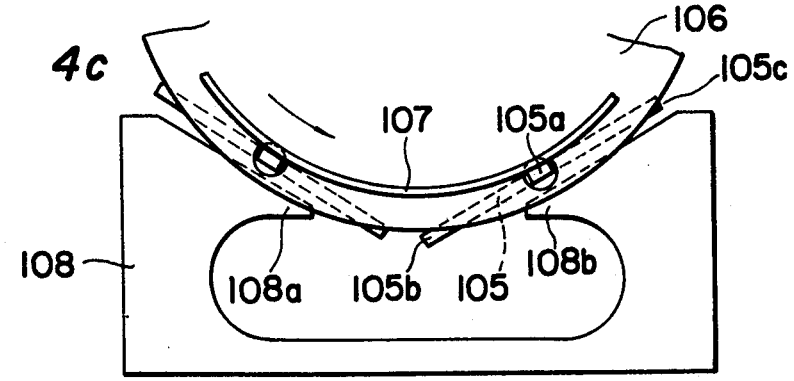

The operation of the indicating device according to the present invention shall be explained in the following with reference to FIGS. 4*a*, 4*b* and 4*c*. In the normal state, as the projecting portions 105*a* are pressed outward of the holes 106*a* by the spring 107, the posture of each digit plate 105 will be regulated in the tangential direction of the arc of the spring 107. Now, when the first "minute" figure indicating drum 106 rotates in the direction indicated by the arrow and comes to the position shown in FIG. 4*a*, one end edge 105*c* of the digit plate 105 will come into contact with a projecting bank portion 108*a* of the turning member 108 so as to be pushed inward, the other end edge 105*b* of the digit plate 105 will engage with the other projecting bank part 108*b* of the turning member 108 and the digit plate 105 will begin to rotate clockwise in the drawing. When the first "minute" figure indicating drum 106 further continues to rotate in the direction indicated by the arrow until it reaches the position shown in FIG. 4*b*, the digit plate 105 will be pushed by the projecting band part 108*b* of the turning member 108 and will rotate clockwise against the spring 107 pressing the projecting portion 105*a* of the digit plate 105 so as to be directed in the tangential direction of the arc of the spring 107. When the first "minute" figure indicating drum 105 further rotates in the direction indicated by the arrow and the digit plate 105 is rotated slightly clockwise from the position shown in FIG. 4*b*, the digit plate 105 will be rotated quickly clockwise by the spring 107 and will return to the posture shown in FIG. 4*c* and thus one turning operation of the digit plate will be completed. In this manner, a total of ten digits printed on the front surfaces and back surfaces of the digit plates 105 will be turned with each rotation of the first "minute" figure indicating drum to thus indicate the digits of "0 and 9" in turn. The case that the first "minute" figure indicating drum 106 rotates in the direction indicated by the arrow, that is, counterclockwise has been described in the above explanation. However, it is needless to say that, even if the first "minute" figure indicating drum 106 rotates clockwise, the above described operation will be only reversed but exactly the same turning operation will be able to be made. The "hour" indicating part in FIG. 2 is also of the same structure as of the above described first "minute" figure indicating part and comprises six digit plates 110 having digits printed respectively on the front surfaces and back surfaces, the drum 111 for respectively rotatably supporting these digit plates and the ring-shaped spring not illustrated so that these digit plates may be turned by the digit plate turning member 112 with each rotation of the drum 111 so as to thus indicate the digits of "0 to 12" in turn.

Figure 5A:
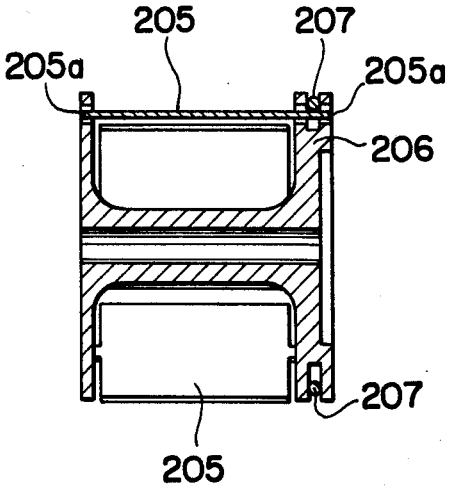
FIGS. 5*a* and 5*b* are respectively a sectioned view and side view of an essential part of another embodiment of the rotary indicating device according to the present invention.
Figure 5B:
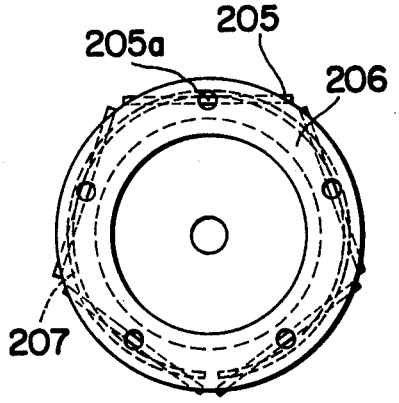

FIG. 5 shows another embodiment of the present invention. In this embodiment, there is shown a rotary indicating device wherein a ring-shaped spring 207 formed so as to be an arc smaller than of the circle including projecting portions 205*a* to be pivots for digit plate 205 in a free state is hung on the projecting portions 205*a* so as to press the projecting portions inward as directed to the center of the rotation of a first "minute" figure indicating drum 206. Thus, an indicating device making exactly the same turning operation as of the already described embodiment can be obtained by the turning member not illustrated.

I claim:

1. A rotary indicating device comprising:

a rotatable drum member having a pair of flange portions opposed to each other;

means defining a plurality of holes in each of said flange portions;

a plurality of indicating plates having a corresponding plurality of projecting portions each of rectangular cross-section and inserted respectively in said holes to make said drum rotatably support said indicating plates;

a turning member having at least one projecting bank portion engageable with said indicating plates to turn them; and a ring-shaped spring fitted to one of said flange portions and resiliently pressing one of said projecting portions of each of said indicating plates along the diametral direction of said drum.

* * * * *